US005518039A

United States Patent [19]

Haeussler et al.

[11] Patent Number: 5,518,039

[45] Date of Patent: May 21, 1996

[54] LENO SELVAGE DEVICE HAVING A LENO ROTOR FORMING THE ROTOR OF AN ELECTRIC MOTOR

[75] Inventors: Horst Haeussler; Hans-Joachim Holz, both of Lindau; Valentin Krumm, Hergensweiler, all of Germany

[73] Assignee: Lindauer Dornier Gesellschaft mbH, Lindau, Germany

[21] Appl. No.: 391,970

[22] Filed: Feb. 21, 1995

[30] Foreign Application Priority Data

Feb. 23, 1994 [DE] Germany ..... 44 05 776.8

[51] Int. Cl.[6] ..... D03C 7/04; D03D 5/00

[52] U.S. Cl. ..... 139/54; 139/50; 139/55.1

[58] Field of Search ..... 139/54, 55.1, 50

[56] References Cited

U.S. PATENT DOCUMENTS

| | | | |
|---|---|---|---|
| 3,880,199 | 4/1975 | Riha et al. | 139/54 |
| 3,945,406 | 3/1976 | Wueger | 139/54 |
| 3,998,247 | 12/1976 | Kovar | 139/54 |
| 4,796,674 | 1/1989 | Wolf et al. | 139/50 |

FOREIGN PATENT DOCUMENTS

| | | |
|---|---|---|
| 2423454 | 4/1975 | Germany . |
| 2832131 | 1/1980 | Germany . |

*Primary Examiner*—Andy Falik
*Attorney, Agent, or Firm*—W. G. Fasse; W. F. Fasse

[57] ABSTRACT

A leno device for tying weft threads in the selvage of a fabric is constructed as an electric motor in which the stator is connected to a mounting bracket and the rotor forms the leno rotor disk or ring. A very compact structure results that can be mounted in the free space between the longitudinal struts and heddles of the first heald shafts in the loom.

3 Claims, 1 Drawing Sheet

LENO SELVAGE DEVICE HAVING A LENO ROTOR FORMING THE ROTOR OF AN ELECTRIC MOTOR

The present application relates to our commonly assigned application U.S. Ser. No. 08/391,551, filed Feb. 21, 1995, Title: Leno Selvage Device for a Loom.

BACKGROUND INFORMATION

German Patent Publication DE 2,423,454 C2 (Riha et al.), published on Apr. 3, 1975, discloses a leno selvage device for reinforcing the selvage by a so-called leno binding or leno weave. The known apparatus comprises a power driven leno disk having a rotational central geometric axis extending in parallel to the weft thread insertion direction in the loom. The leno disk is driven with the same r.p.m. as the r.p.m. of a carrier carrying leno thread supply spools. The leno disk has two eyelets arranged symmetrically relative to the central rotational axis of the disk.

The known leno device has two sections. One section is positioned on each side of the loom next to the respective warp threads. Both leno sections are driven through a coupling such as a gear belt connected to a drive wheel for a positive drive. The drive wheel is connected rigidly to a reduction gear shaft which in turn is driven by a reduction gear. The reduction gear with its shaft is coupled in a drive power transmitting manner with the main drive shaft of the loom.

For adapting the leno device of German Patent Publication DE 2,423,454 C2 to different weaving widths, the reduction gear shaft is coupled to a hollow shaft extending in the direction of the weaving width adjustment, namely in the direction of the weft insertion. A shaft section that drives the second leno device and the second leno spool holder is axially displaceable relative to the hollow shaft.

Deriving the drive power for both leno sections from the main loom drive requires a substantial number of drive components and hence is expensive. These drive components also require a substantial space in the loom and it is not possible to control the two leno sections independently of the main loom drive nor independently of each other.

German Patent Publication (DE-OS) 2,832,131 (Shindo et al.), published on Jan. 31, 1980, discloses a leno device for forming a leno selvage in a shuttleless loom, wherein the leno disk is part of a so-called satellite leno device. The leno disk has outer gear teeth meshing with other gears of the satellite gear drive of the leno device. The leno disk is rotatably mounted on a steady rest type carrier arm. The leno threads are pulled off from a spool rotor which is rotationally coupled to the leno disk. The leno threads pass through a substantially centrally located guide opening in the leno disk which additionally comprises two thread eyes positioned diametrically opposite each other in the leno disk. The threads pass through these thread eyes to the tie-up point along the selvage of the fabric.

The outer gear teeth of the leno disk mesh with the gear teeth of a drive gear wheel of the satellite gear drive which drives the leno disk and the respective leno spool holder in synchronism with each other.

German Patent Publication (DE-OS) 2,832,131 shows a drive shaft 44 for the satellite leno device and it is assumed that the drive power for the shaft 44 is derived from the main loom drive as is customary. As a result, the same drawbacks apply as have been mentioned above. Further, such conventional leno drives are not easily adapted to different weaving widths as is especially shown by German Patent Publication DE 2,423,454 C2 first mentioned above.

Conventionally, a relatively large space is required for the leno devices on the right-hand side and on the left-hand side of the loom shed formed by the warp threads. The conventional leno devices are arranged in the area of the rear shed which means that the number of heald shafts is limited by the position of the leno devices. Further, the length of the leno threads measured from the leno device to the tie-up point of the weft thread is relatively large. As a result, the leno front shed formed by the leno threads is relatively flat or rather the angle enclosed by the two leno threads is relatively acute, which has the drawback that it is not assured that each weft thread end is properly inserted into the leno shed.

Conventionally it is necessary to rotate the leno thread supply spool carriers to avoid twisting of the leno threads in the area of the rear shed. The twisting must be avoided because it can break the leno threads. The rotation of the leno thread spool carriers makes sure that untwisted leno threads are presented to the leno disk.

OBJECTS OF THE INVENTION

In view of the above it is the aim of the invention to achieve the following objects singly or in combination:

- to avoid the drawbacks of the prior art and to make sure that each weft thread end is properly inserted into the leno shed at each selvage;
- to construct the leno sections so that each leno section is individually drivable and controllable whereby the operation of the leno sections and their construction are independent of the main loom drive;
- to make sure that each end of the weft thread is properly tied-up in the leno selvage to obtain a high quality and durable leno selvage;
- to construct a leno selvage device in such a way that upon changing to another fabric it is not necessary to separate the leno selvage device from the loom, whereby the present selvage device shall be easily adaptable to different weaving widths to thereby substantially reduce the set up time of the loom;
- to avoid a separate drive for the leno thread spool carriers while still preventing twisting of the leno threads;
- to use, compared to the relatively small leno thread capacity of conventional leno supply spools in a so-called satellite leno system, large capacity leno thread supply spools of the so-called "king spool" type to assure long weaving times as compared to the relatively short weaving times in satellite leno spool systems; and
- to provide a compact, yet simple construction of the leno device in such a way that the leno rotor ring will be driven without any need for drive transmission components between a drive motor and the leno rotor ring.

SUMMARY OF THE INVENTION

The above objects have been achieved according to the invention by a leno selvage device in which the stator of an electric motor is constructed as a mounting and the leno rotor is constructed as the rotor of the electric motor. It is an advantage of such a structure that it requires very little space, that it is directly controllable independently of the main loom drive, and that it can be mounted in a small space between longitudinal struts and heddles of the heald shafts near the selvage of the fabric in a loom on each loom side.

Further, the leno selvage device according to the invention is easily position adjustable in an angular direction as well as in an axial direction parallel to the weft thread insertion direction by mounting the electric motor or rather its stator that forms part of the present leno device with a clamp on a stub or rod that extends in the weft insertion direction and is connected to the loom frame.

The construction according to the invention makes it possible for the first time to control the motion sequence of the individual leno selvage devices independently of one another and independently of the main loom drive. Thus it is, for example, possible that the tie-up of the weft threads takes place in dependence of the type of weft thread. Further, the trailing end of a weft thread at the weft insertion side of the loom can now be tied-up even prior to tying the weft thread end at the weft exit side of the loom.

Yet another advantage of the individual control that is now possible according to the invention is seen in that various types of selvages and weft densification can be accomplished with different types of tie-ups without any additional structural effort and expense. Thus, single weft tie-up as well as multi-weft tie-ups are possible solely by a respective control of the oscillations of the motor rotor that directly forms the rotor ring of the present selvage device. The motor is driven by a respective control program that may coordinate the leno drive with the main loom drive.

Due to the controlled oscillation of the present leno rotor ring, it is possible to avoid separate drives for the leno thread supply spool holders altogether. The twisting of the leno threads is avoided by the back and forth oscillating movements of the leno rotor ring or by a controlled number of revolutions of the leno rotor ring first in one direction and then by the same number of revolutions in the opposite direction.

Furthermore, it is possible to coordinate the control, or rather the control program for the present leno drive motor with the loom drive components or controls that form the loom shed with the warp threads. In this connection it is desirable to assure a substantial congruence between the motion sequence that forms the loom shed and the motion sequence that forms the leno shed to assure an optimal opening of the leno shed when the weft thread wants to enter into the respective leno shed. This feature makes sure that the weft threads properly enter into the leno shed on both sides of the loom shed for proper tie-up.

Another advantage of the present leno device is seen in that it can be mounted close to the beat-up point of the fabric and between the heald frame and the heddles of the first heald shafts. This feature does not limit the number of heald shafts that can be placed in the direction toward the warp beam, namely in the direction opposite to the fabric advance.

The compact construction combined with the angular and axial adjustability makes it possible to easily change the position of the leno devices on each side of the loom in accordance with the requirements of different types of weave and in accordance with the weaving width of any particular fabric. These changes may be rapidly accomplished so that a set-up time is minimized.

Another advantage of the present leno device is seen in that it permits a substantially shorter leno stroke of about 80 mm due to the position of the present device between the heald shafts just upstream of the reed as compared to the conventional satellite leno device that is positioned upstream of the heald shafts near the warp beam and requires a leno stroke of about 180 mm to assure a sufficient opening of the leno shed. The leno stroke here is the maximum spacing between the two leno threads as they open the leno shed.

Yet another important advantage of the invention is seen in that no drive transmission components are required between the drive motor and the leno rotor ring because the latter is directly the rotor of the drive motor. Thus, all gear drives and gear belts are avoided according to the invention.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
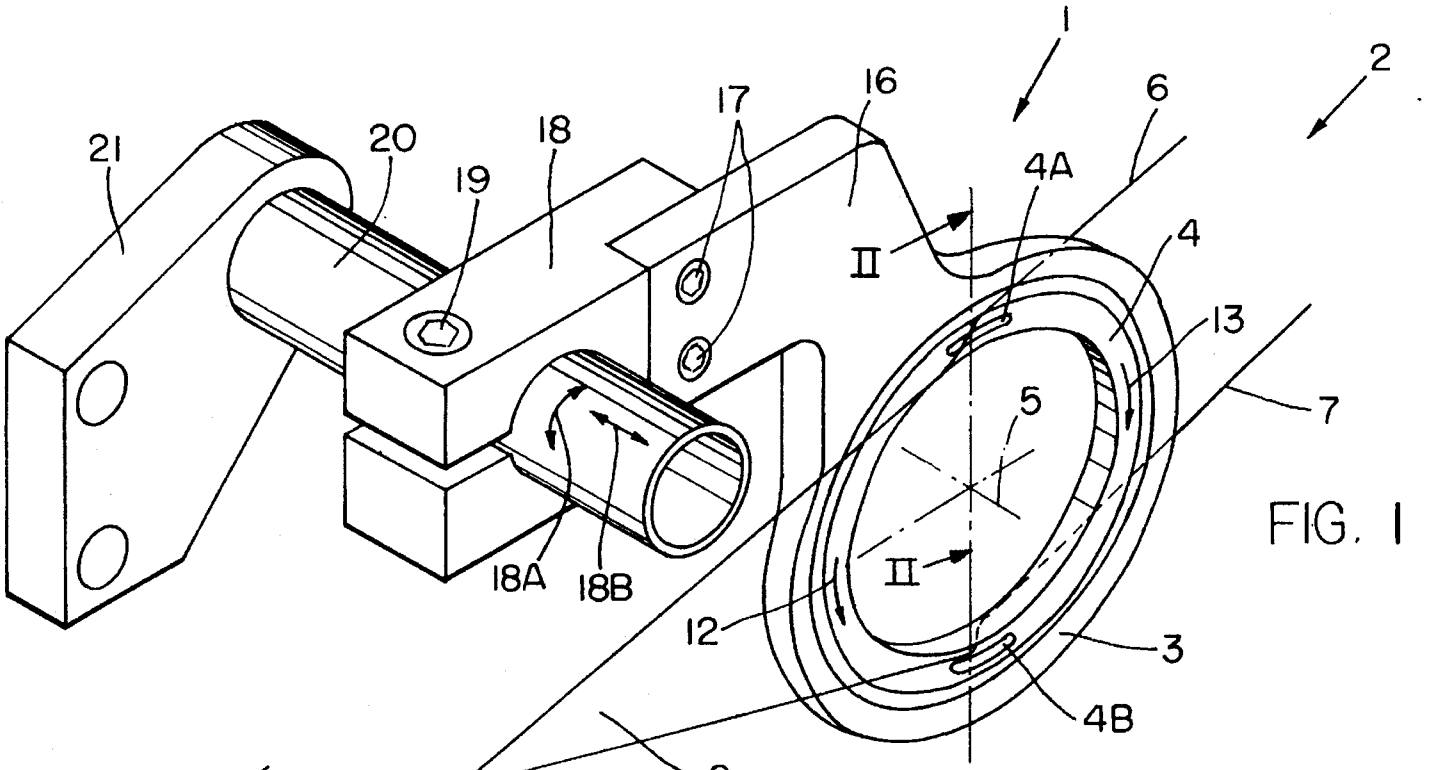
FIG. 1 is a simplified perspective view of a leno selvage device according to the invention, wherein the device itself is constructed as a controllable electric motor.

FIG. 1 shows a leno device 1 of the invention comprising an electrically controllable drive motor 2 having a stator 3 and a rotor 4. The rotor 4 simultaneously forms a rotor disk or preferably the rotor ring 4 of the leno device. A rotor ring results in a lightweight construction. The arrangement is such that the rotational axis 5 of the rotor ring 4 extends in parallel to the weft insertion direction. The rotor ring 4 is provided with two leno eyelets or slots 4A and 4B. These slots are arranged diametrically opposite each other and symmetrically relative to the rotational axis 5. Leno threads 6 and 7 coming from supply spools not shown pass through the respective holes 4A and 4B. The oscillation of the rotor ring 4 back and forth as indicated by the arrows 12 and 13 forms the forward leno shed 8 with the tie-up point 9 of the weft threads 11 in the selvage of the fabric 10 which travels in the direction of the arrow 10A. The arrangement is such that the leno shed 8 opens adequately relative to the loom shed not shown, for the proper insertion of the ends of the weft threads 11. A very tight binding or tie-up of the leno threads is achieved in this manner by the oscillation of the ring 4.

The stator 3 is connected to a mounting bracket 16 which in turn is secured by screws 17 to a mounting clamp 18. The mounting clamp 18 can be tightened by a screw 19 on a mounting stub or rod 20 which in turn is secured to a bracket 21 that is connected to the loom frame not shown. The adjustment of the position of the leno device 1 can be accomplished in an angular manner as indicated by the arrow 18A and in an axial manner as indicated by the arrow 18B. Merely the screw 19 needs to be loosened for the adjustment and then tightened again when the leno device 1 is in the proper position.

Figure 2:
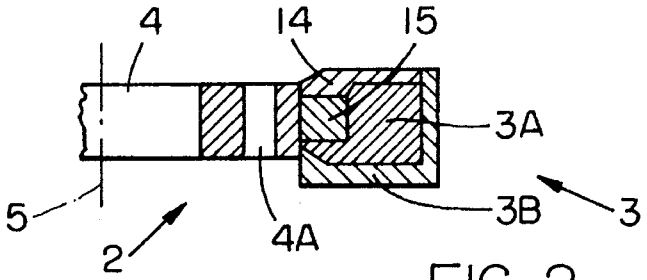
FIG. 2 is a sectional view along section line II—II in FIG. 1 showing the selvage leno rotor as a motor rotor.

The sectional view of FIG. 2 shows the construction of the present leno device 2 as a motor with a rotor ring 4 having the above mentioned eyelets or slots of which only slot 4A is seen in FIG. 2. The rotor ring 4 carries on its circumference either magnets 15 or a rotor winding. A stator winding 3A is mounted in a stator housing 3B closed by a stator cover 14. The leno rotor 4 is preferably constructed as a ring as described in order to reduce its mass. But a disk is also possible. In both instances leno thread supply spools as disclosed in the above copending application may be mounted in or on the ring or disk. The disclosure of the copending application (08/391,551) is incorporated herein by reference.

Either the stator cover 14 or the stator housing 3B is connected to the mounting bracket 16 as described above. The leno device 2 is arranged on the left-side of a loom as viewed against the advanced direction 10A. A mirror-symmetrical device, not shown, will be arranged on the right-hand side of the loom. Both devices will be positioned in the free space between the heald frame and the heddles of the first heald shafts just upstream of the reed not shown.

The present construction of the leno device 2 as an electric motor with a leno rotor ring 4 has the advantage that a separate rotary drive for the leno thread supply spools can be obviated because by programming the rotation of the ring 4, twisting of the leno threads can be avoided. For example, a determined number of revolutions in one direction can be followed by the same number of revolutions in the opposite direction to thereby compensate any twisting tendency of the leno threads 6 and 7 in the area of the rear leno shed, not shown.

Instead of several revolutions in one and then in the opposite direction, it is also possible to simply oscillate the rotor ring 4 as indicated by the arrows 12 and 13, whereby any twisting tendency is also compensated so that separate rotary drives for the leno thread supply spools are avoided.

By controlling the leno device 2, or rather the motor, with a respective control program, it is possible to form different bindings for the weft threads. For example, each weft thread 11 may be bound individually as shown in FIG. 1 or several weft threads may be bound as a group, for example, two or three weft threads may be bound with each twist or tie-up by a respective oscillatory motion of the rotor ring 4 after two, three, or more weft threads have been inserted into the respective leno shed as shown in FIG. 5 of the copending application.

Although the invention has been described with reference to specific example embodiments, it will be appreciated that it is intended to cover all modifications and equivalents within the scope of the appended claims.

What we claim is:

1. A leno selvage device for a loom, comprising a controllable electric motor having a stator including a mounting and a leno rotor having two leno thread guides arranged diametrically opposite each other in said leno rotor, said stator and said leno rotor being connected to said mounting thereby forming a structural unit.

2. The leno selvage device of claim 1, wherein said mounting comprises a mounting bracket and a mounting clamp connected through said mounting bracket to said stator, said mounting further comprising a rod or stub adapted for connection to a loom frame, said mounting clamp being adjustable in a selected position on said rod or stub, and a clamp tightening element for fixing said structural unit in an adjusted position on said rod or stub.

3. The leno selvage device of claim 1, wherein said leno rotor is a ring, disk, or wheel.

* * * * *

UNITED STATES PATENT AND TRADEMARK OFFICE

CERTIFICATE OF CORRECTION

PATENT NO. : 5,518,039

DATED : May 21, 1996

INVENTOR(S) : Horst Haeussler et al.

It is certified that error appears in the above identified patent and that said Letters Patent is hereby corrected as shown below:

Column 1, above line 10, please insert the following paragraph:

--FIELD OF THE INVENTION

The invention relates to a leno selvage device forming a leno binding of the weft thread ends in the selvage along both egdes of a fabric.--

Signed and Sealed this

Tenth Day of September, 1996

*Attest:*

*Attesting Officer*

BRUCE LEHMAN

*Commissioner of Patents and Trademarks*